US009163348B2

(12) United States Patent
Marioni

(10) Patent No.: US 9,163,348 B2
(45) Date of Patent: Oct. 20, 2015

(54) METHOD FOR MEASURING THE MOMENT OF INERTIA OF A DRUM OF A WASHING MACHINE AND WASHING MACHINE ARRANGED TO IMPLEMENT SAID METHOD

(75) Inventor: Elio Marioni, Dueville (IT)

(73) Assignee: Askoll Holding S.r.l. (IT)

( * ) Notice: Subject to any disclaimer, the term of this patent is extended or adjusted under 35 U.S.C. 154(b) by 1029 days.

(21) Appl. No.: 13/160,058

(22) Filed: Jun. 14, 2011

(65) Prior Publication Data

US 2011/0303252 A1 Dec. 15, 2011

(30) Foreign Application Priority Data

Jun. 14, 2010 (IT) ..... BO2010A0377

(51) Int. Cl.
*D06F 37/20* (2006.01)
*D06F 39/00* (2006.01)

(52) U.S. Cl.
CPC ..... *D06F 39/003* (2013.01); *D06F 37/203* (2013.01)

(58) Field of Classification Search
CPC ... D06F 39/003; D06F 37/203; D06F 37/304; D06F 2202/065; D06F 2202/12
USPC ..... 68/12.04, 12.06; 318/432, 471, 318/700–724
See application file for complete search history.

(56) References Cited

U.S. PATENT DOCUMENTS

| | | | | |
|---|---|---|---|---|
| 4,741,182 | A | 5/1988 | Didier et al. | |
| 7,162,759 | B2 | 1/2007 | Weinmann | |
| 2004/0211009 | A1 * | 10/2004 | Murray et al. | 8/159 |
| 2006/0238152 | A1 * | 10/2006 | Marioni | 318/268 |
| 2008/0041115 | A1 | 2/2008 | Kanazawa et al. | |
| 2008/0289118 | A1 * | 11/2008 | Park et al. | 8/159 |
| 2009/0199598 | A1 * | 8/2009 | Kanazawa | 68/12.04 |
| 2010/0306926 | A1 * | 12/2010 | Altinier et al. | 8/137 |

FOREIGN PATENT DOCUMENTS

| | | | |
|---|---|---|---|
| DE | 4431846 | A1 * | 3/1996 |
| EP | 1835062 | A1 | 9/2007 |
| JP | 2003210888 | A * | 7/2003 |

OTHER PUBLICATIONS

Kirshnan, Permanent Magnet Synchronous and Brushless DC Motor Drives, Sep. 25, 2009, CRC Press, p. 401.*
DE4431846—Machine Translation, Mar. 1996.*
JP2003210888—Machine Translation, Jul. 2003.*
European Search Report issued in connection with European Patent Application No. 11 16 9751.

* cited by examiner

*Primary Examiner* — Michael Kornakov
*Assistant Examiner* — Marc Lorenzi
(74) *Attorney, Agent, or Firm* — Akerman LLP

(57) ABSTRACT

A method for measuring the moment of inertia of a washing machine drum containing a load. The drum is set in a rotation by means of a permanent magnet synchronous electric motor taking it to a first angular spin velocity. The method includes identifying a synchronization point in a periodic signal indicative of the torque provided by the synchronous electric motor at the first angular velocity. An acceleration transient of said drum with constant electromotive torque is provided by the synchronous electric motor. The method further includes interrupting the acceleration transient upon reaching a second angular velocity, acquiring the acceleration transient time duration, and processing an indirect measurement of the moment of inertia of the drum starting from a value of the torque yielded to the drum during the acceleration transient, from the transient time duration value, and from the variation of the angular velocity in the transient.

10 Claims, 4 Drawing Sheets

METHOD FOR MEASURING THE MOMENT OF INERTIA OF A DRUM OF A WASHING MACHINE AND WASHING MACHINE ARRANGED TO IMPLEMENT SAID METHOD

CROSS-REFERENCE TO RELATED APPLICATIONS

The present application claims priority to Italian Patent Application No. BO2010A000377, filed Jun. 14, 2010, the entirety of which is incorporated herein by reference.

FIELD OF APPLICATION

The present invention refers, in the most general aspect thereof, to a method for measuring the moment of inertia of a drum of a rotary drum washing machine.

In particular, the method applies to washing machines, laundry machines or similar machines, for household or industrial use, comprising a rotary drum for the introduction of articles to be subjected to washing, drying or centrifuge cycles. In the present description, the machines of the type indicated above are generally referred to by the term washing machines.

PRIOR ART

As known, washing machines comprise a drum, rotating within a drum, rotated by an electric motor, which—in most cases—is connected to the drum by means of a transmission drive pulley.

The user introduces—into said drum—a load represented by the laundry to be washed which, upon reaching a given spin velocity (generally comprised between 80 and 120 revolutions per minute), is pressed substantially uniformly along the peripheral walls of the drum.

The washing and or drying process can be advantageously optimised according to the laundry load contained in the drum, for example adjusting—as a function thereof—some operating parameters such as the water flow and the amount of detergent introduced, the rotation velocity of the drum, the duration of the subsequent washing steps.

A measurement of the moment of inertia of the loaded drum, performed by the electronic control unit just before the washing and/or drying process, allows obtaining information regarding the introduced load hence allowing the abovementioned process optimization.

The prior art, represented by the U.S. Pat. No. 7,162,759, discloses a method for indirect determination of said moment of inertia. Such method provides for monitoring, by measuring the voltage and current development of a power supply circuit, the instantaneous electrical power absorbed during an acceleration transient of the drum. The power absorbed during the transient, from which a term regarding the frictions is subtracted to obtain a value substantially proportional to the moment of inertia of the loaded drum, is calculated by integrating such power with respect to time. Though substantially meeting the purpose, the aforementioned method according to the prior art reveals some drawbacks.

Firstly, the measurements performed through said method are relatively inaccurate.

One of the reasons for such inaccuracy derives from possible unbalanced load. As a matter of fact, though spinning ideally determines an axial-asymmetric distribution of the load in the drum, the load is actually often unbalanced. Such unbalanced load causes an oscillation—even marked—of the power required from the motor to rotate the drum, such oscillation causing a measurement error regarding the aforementioned load.

The error due to the unbalanced load may be unacceptable should the velocity of the start and end of transient be relatively close, for example 95 and 135 revolutions per minute. Thus, a further drawback of the known method derives from the design limitation related to the choice of such velocities; in particular the method cannot be advantageously implemented on a short acceleration ramp.

Furthermore, the method provided for requires considerable computational weight, mainly due to the operation of integrating power with respect to time. A method for determining the moment of inertia with characteristics different from the one described previously is disclosed by the U.S. Pat. No. 4,741,182. However, also such method reveals drawbacks related to measurement inaccuracies due to the unbalanced load.

Thus, the technical problem on which the present invention is based is that of providing an alternative method for measuring the moment of inertia, capable of overcoming the drawbacks of the prior art.

SUMMARY OF THE INVENTION

The aforementioned technical problem is resolved by a method for measuring the moment of inertia of a washing machine drum containing a load, comprising the steps of:

- set said drum in rotation by means of a permanent magnet synchronous electric motor taking it to a first angular spin velocity;
- identifying a synchronisation point in a periodic signal indicative of the torque delivered by the synchronous electric motor, i.e. the load unbalance position, at said first angular velocity;
- starting, at said synchronisation point, an acceleration transient of said drum with constant electromotive torque delivered by the synchronous electric motor;
- interrupting the acceleration transient upon reaching a second angular velocity;
- acquiring a time duration of the acceleration transient;
- processing an indirect measurement of the moment of inertia of said drum starting from a value of the torque yielded to the drum during the acceleration transient, from the time duration value of the acceleration transient, and from the variation of the angular velocity in the acceleration transient, according to the formula:

$$J = \frac{T_{acc} \cdot \Delta t}{\Delta \omega}.$$

The use of a constant torque acceleration transient advantageously allows simplifying the formula for calculating the moment of inertia. Actually, the method according to the invention does not require the integration operations which characterise the prior art, hence implying a lower computational cost for the control unit that performs the measurement.

Given that the torque oscillation at a constant velocity mainly due to the rotation of the unbalanced load, the identification—on the torque signal—of a synchronisation point for starting the acceleration transient means starting the transient always at an unbalanced load position known a priori. Such solution allows greater measurement accuracy, eliminating the measurement error identified in the known art. Hence, the method according to the present invention can advantageously be implemented even with relatively short acceleration transients, for example from 90 to 135 revolutions per minute.

The method subject of the invention can measure the torque delivered by the electric motor at the first angular velocity and that delivered at the second angular velocity. Thus, an efficient estimation of the torque required to overcome the frictions during the acceleration transient by calculating the average value of the two torques measured at the ends of the transients, can then be performed. Said average value can thus be subtracted from the value of the electromotive torque delivered during the acceleration transient to obtain an estimation of the value of torque yielded to the drum.

Given the characteristics of the permanent magnet synchronous electric motor, the signal of the absorbed quadrature current $I_q$ can advantageously be used as the signal indicative of the torque delivered with respect to that identifying the synchronisation point. In particular, the synchronisation point can be a peak point (maximum or minimum) of the signal, which can be easily identified by analyzing the derivatives.

The step of starting an acceleration transient may provide for taking the quadrature current $I_q$ of the motor to a predefined value, which is maintained constant during the entire transient time. As known, the torque delivered by a synchronous motor is substantially proportional to the absorbed quadrature current $I_q$, hence the constant current condition also guarantees a constant torque.

The step of interrupting the acceleration transient upon reaching a second angular velocity may provide for the periodic acquisition, during the acceleration transient, of an angular velocity of the drum through a position sensor. Alternatively, the velocity can be estimated in sensorless mode. Upon reaching (detected or estimated) the desired second angular velocity, the synchronous electric motor, initially maintained at constant quadrature current $I_q$, moves to a feedback control in which it is maintained at angular velocity equivalent to said second angular velocity.

Also the step of setting the drum in rotation taking it to a first angular velocity can advantageously provide for a feedback control of the synchronous electric motor. The angular velocity thereof, acquired by the position sensor, will then be compared with the desired first angular velocity. Also in this case, the velocity can alternatively be estimated in sensorless mode.

The position sensor used can for example be a Hall effect sensor.

As known, the torque delivered by the permanent magnet synchronous electric motor is proportional to the product of the quadrature current $I_q$ and the magnetic flux $\Phi$ linked by the stator magnetic circuit. The value of the magnetic flux $\Phi$ is thus used in the present method to obtain the torque delivered by the synchronous electric motor starting from the value of absorbed quadrature current $I_q$.

Such flux is theoretically known given the characteristics of the stator magnetic circuit; practically, it can however diverge from the theoretical value due to the production variability. A step for estimating the value of magnetic flux starting from state variables of the motor can be included in the present method with the aim of improving the measurement accuracy.

In particular, the step of estimating the value of the magnetic flux $\Phi$ can apply an estimation algorithm which uses correction coefficients to compensate the errors made when measuring state variables of the motor and when estimating the operating parameters thereof.

It should be observed that the estimation algorithm, should the present method be implemented without using the position sensor, can also enable the estimation of the velocity of the drum.

Another error observed when estimating the magnetic flux $\Phi$ is due to the influence of temperature; such error can be advantageously compensated by acquiring a temperature value of the synchronous electric motor through a heat sensor.

The step of estimating the magnetic flux $\Phi$ can advantageously apply a method simplified with respect to the use of the estimation algorithm outlined above.

For example, the flux can be estimated by correcting a nominal value of magnetic flux $\Phi_{ref}$ at a reference temperature $T_{ref}$ according to a measured motor temperature T.

In such case, the following formula can be applied:

$$\Phi=\Phi_{Ref}(T-T_{Ref})(1-\delta)$$

wherein the measured temperature should be greater than the reference temperature, which can for example be 25° C. and where $\delta$, thermal coefficient of the magnet, is normally equivalent to 0.002.

The value of magnetic flux $\Phi$ can be estimated more accurately considering a correction coefficient k, identifying the construction variability of the motor, measured by way of experiment by operating the motor with known torque in a testing step.

The following formula can also be advantageously applied:

$$\Phi=k\cdot\Phi_{Ref}(T-T_{Ref})(1-\delta).$$

The previously outlined technical problem is also resolved by a washing machine comprising: a rotary drum; a permanent magnet synchronous electric motor for rotating said drum; a control unit connected to said synchronous electric motor; said control unit being provided for implementing the previously described method.

The washing machine may also comprise a position sensor connected to said control unit to detect an angular position of said drum.

Further characteristics and advantages of the present invention will be apparent from the description of a preferred embodiment, provided hereinafter by way of non-limiting example with reference to the attached drawings.

DETAILED DESCRIPTION

Figure 1:
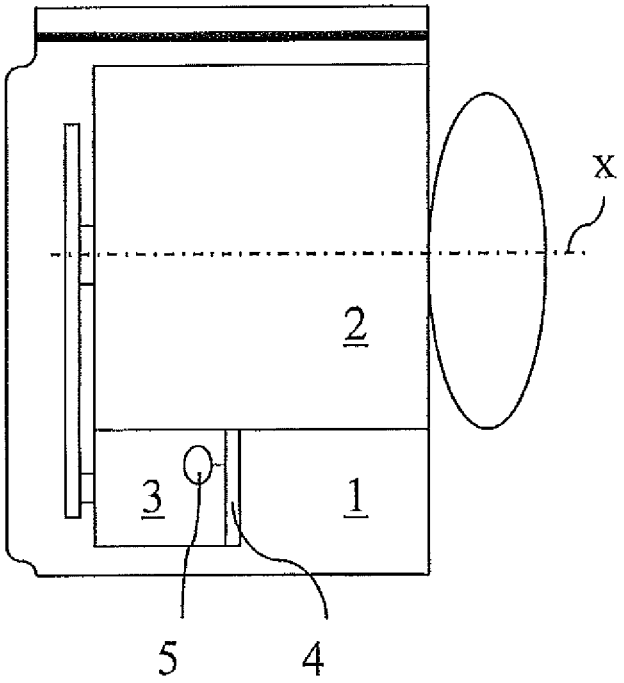
FIG. 1 schematically represents a structure of a washing machine provided for implementing the method according to the present invention.

With reference to the attached FIG. 1, a washing machine comprising a drum 2, mounted in a housing drum according to a horizontal rotational axis x, and a synchronous electric motor 3 provided for moving the drum 2 around the rotation axis x is generally identified with 1.

The drum 2 is provided for receiving laundry or other articles to be washed therein; in the rest of the present description such drum content will be generally referred to by the term load.

In particular, the synchronous electric motor 3 is of the permanent magnet type with external cup rotor connected—in a known manner—with a driving belt to the previously identified rotary drums 2.

The synchronous electric motor 3 is associated to a control unit 4, comprising a motor driving circuit, which has the purpose of executing the method for measuring the moment of inertia described below. Said control unit 4 is connected to a Hall effect sensor 5 for detecting the angular velocity of the synchronous electric motor 3.

Before passing to the detailed description of the specific steps of the measurement method according to the present invention, following are some introductory observations regarding the implemented calculation technique.

The kinetic energy of the system constituted by the drum 2 rotating at an angular velocity ω and by the load thereof can be expressed using the general formula for rotary systems:

$$E_c = \tfrac{1}{2} J\omega^2 \tag{1}$$

where J is the moment of inertia intended to be obtained.

Power is obtained by deriving both terms with respect to time:

$$P = J\omega\alpha \tag{2}$$

which can be otherwise expressed as the product of the torque T and angular velocity ω. Exploiting the equivalence between the two expressions of power it can thus be observed that:

$$J\alpha = T \tag{3}$$

Now, let us assume to accelerate the system taking it, during an acceleration transient of time Δt, from a first angular velocity $\omega_1$ to a second angular velocity $\omega_2 = \omega_1 + \Delta\omega$, still maintaining the torque constant at a value $T_{acc}$. Integrating both terms of the equation (3) with respect to time it is then observed that:

$$J \cdot \Delta\omega = T_{acc} \cdot \Delta t \Rightarrow J = \frac{T_{acc} \cdot \Delta t}{\Delta\omega} \tag{4}$$

The electromotive torque delivered by a permanent magnet synchronous motor is obtained from the formula:

$$T_{em} = \frac{2}{3}\frac{pp}{\sqrt{2}}\Phi N I_q \tag{5}$$

where pp indicates the number of poles of the motor, Φ the magnetic flux linked by the magnetic circuit, N the number of coils and $I_q$ the absorbed quadrature current.

Now, the number of poles pp and coils N are construction quantities of the motor known a priori.

The magnetic flux Φ is a quantity known from the morphology of the magnetic circuit, though with inaccuracies due to the production variability and influence of temperature.

The absorbed current $I_q$, obtainable in a known manner starting from the phase currents of the motor by means of the known Park and Clark transformations, can be directly measured and controlled by the control unit 4.

The control unit 4 is thus capable of evaluating the electromotive torque $T_{em_acc}$ delivered by the motor during the acceleration transient; the yielded torque $T_{acc}$, i.e the electromotive torque $T_{em_acc}$ excluding the torque required to overcome the frictions of the rotary system during the acceleration transient, is however required to obtain the moment of inertia J through the formula (4). The useful estimation of this variable can be obtained through a simple calculation of the average of the torques detectable at constant angular velocity (and thus entirely caused by the frictions) at the first $\omega_1$ and the second angular velocity $\omega_2$, i.e. the start and end velocity of the transient. Finally, the moment of inertia J can be efficiently estimated through the formula:

$$J = \frac{\frac{2}{3}\frac{pp}{\sqrt{2}}\Phi N\left[I_{q_acc} - \left(\frac{I_{q_1} + I_{q_2}}{2}\right)\right] \cdot \Delta t}{\Delta\omega} \tag{6}$$

where $I_{q_acc}$, $I_{q_1}$ and $I_{q_2}$ are values of the quadrature current respectively during the acceleration transient, at the first angular velocity cm and at the second angular velocity $\omega_2$.

Figure 2:
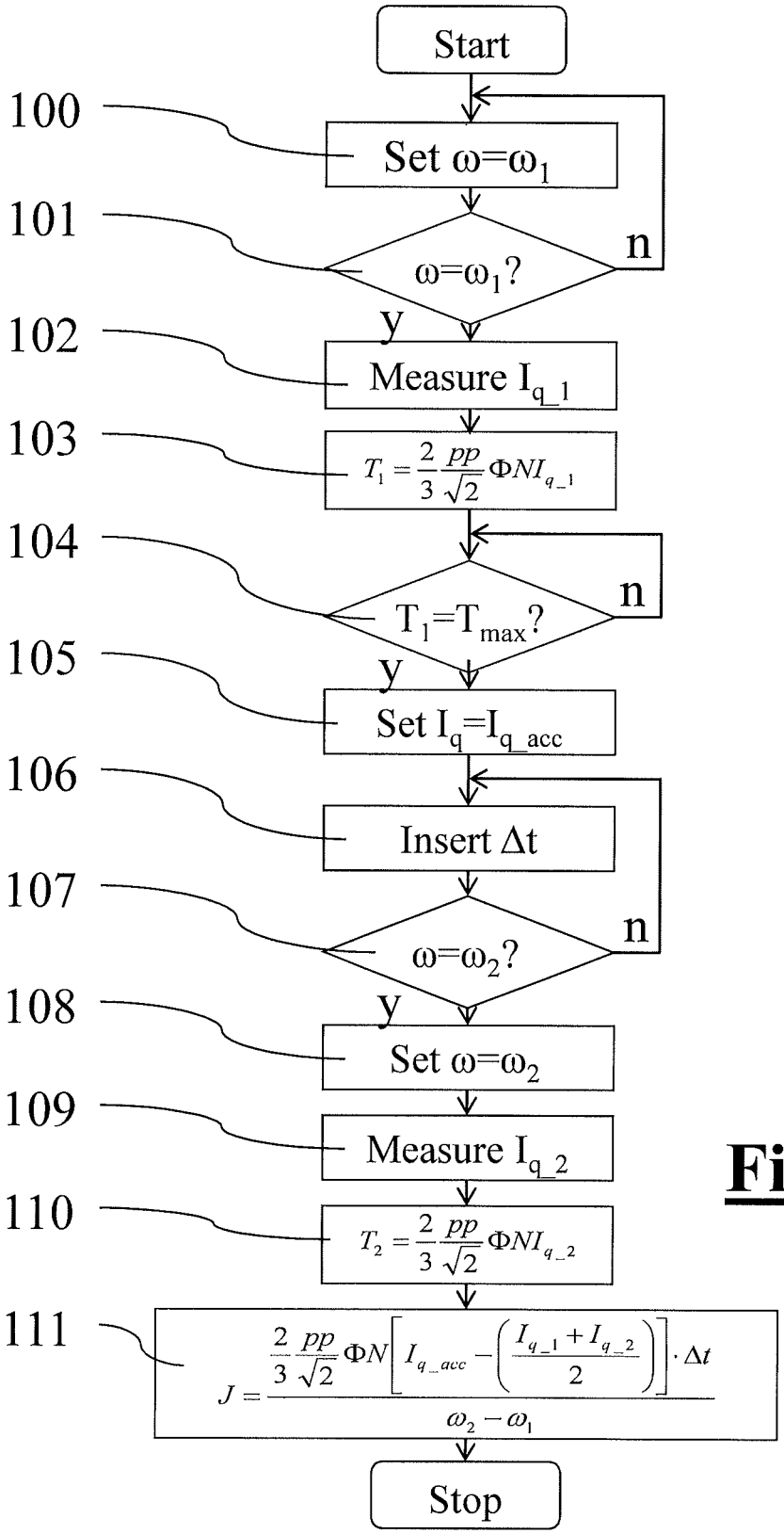
FIG. 2 represents a block diagram of the method according to the present invention.
Figure 3:
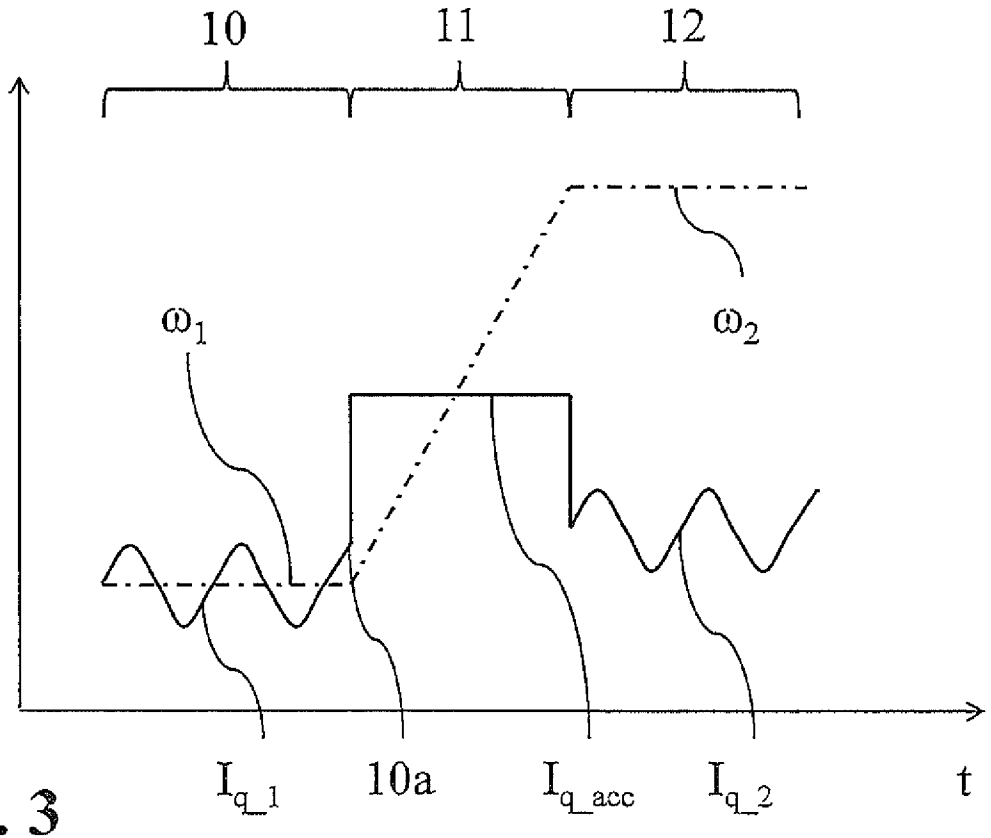
FIG. 3 represents a chart of the time development of the quadrature current signals of the synchronous motor (bold line) and angular velocity of the drum (dashed line) in the implementation of the present method.

With reference to the block diagram indicated in FIG. 2, following is a detailed description of the single steps of the method for measuring the moment of inertia of the drum 2.

The method, which can be advantageously implemented when starting the washing cycle of the washing machine 1, provides for a first step which consists in taking the drum 2 to the first angular velocity $\omega_1$. Such angular velocity should be greater than the load spin velocity; in the present example a value of the first angular velocity $\omega_1$ is considered equivalent to 95 revolutions per minute, assuming that the load is pressed against the drum at 80 revolutions per minute.

The drum is brought to the first angular velocity $\omega_1$ proceeding in the known manner by operating on the control variables of the electric motor 3 (block 100 of FIG. 2) and by feedback controlling whether the drum 2 has reached the desired velocity (block 101).

The control unit 4 uses the Hall effect sensor 5 to detect the angular velocity of the rotor.

Upon reaching the first angular velocity $\omega_1$, the drum 2 rotates at constant velocity during a first stage 10 of measurement cycle.

In said first stage, just like in the subsequent stages, the load of the drum 2 is pressed against the drum. However, as mentioned in the paragraph addressing the prior art, the distribution of the load along the inner wall of the drum 2 is not uniform. Thus the load is always somehow unbalanced to some extent, hence the torque required to rotate it at constant velocity has an oscillating trend, with period coinciding with the rotation period of the drum 2. Hence, also the quadrature current $I_q$ absorbed by the electric motor 3 oscillates around a mean value.

In this first stage, the control unit 4 acquires said mean value (block 102); such value represents the quadrature current $I_{q_1}$ at the first angular velocity $\omega_1$ to be used in the equation (6).

According to said value of quadrature current $I_{q_1}$ the control unit can evaluate, using the equation (5) described previously, the torque $T_1$ required from the motor to overcome the frictions of the rotary system at the first angular velocity $\omega_1$ (block 103).

The first stage 10 of the measurement cycle is followed by a second stage 11 constituted by the acceleration transient towards the second angular velocity $\omega_2$. A value of the second angular velocity $\omega_2$ equivalent to 135 revolutions per minute is considered in the present example.

The start of the acceleration transient is synchronized with a determined load unbalance position with the aim of guaranteeing uniformity between the various measurements of the moment of inertia J performed through the present method. As argued above, the periodic signal of the quadrature current $I_q$ during the first stage 10 represents the unbalanced load; hence, a maximum peak of said signal (block 104) is identified as the synchronisation point 10*a* in the present example.

Given that the quadrature current signal $I_q$ is substantially sinusoidal, the peak thereof can be easily determined through known methods, for example by evaluating the derivatives of the signal. It should be observed that a minimum peak of the quadrature current signal $I_q$, can be alternatively and equally easily identified as the synchronisation point 10*a*.

Thus, the control unit 4 starts the acceleration transient raising the control variable of the synchronous electric motor 3, i.e. the quadrature current $I_q$, to a predefined value $I_{q_acc}$ (block 105) at the identified synchronisation point 10*a*. Said value $I_{q_acc}$ is maintained constant during the entire acceleration transient thus meeting the aforementioned condition of constant electromotive torque $T_{em_acc}$.

The acceleration transient is interrupted and the measurement cycle enters a third stage 12 in which the velocity of the drum 2 is maintained constant after reaching the value (block 108), only when the control unit 4 detects that the second angular velocity $\omega_2$ (block 107) has been reached.

The control unit 4 measures both the acceleration transient time $\Delta t$ (block 106), and, upon reaching the third stage 12, the value of the quadrature current $I_{q_2}$ at the second angular velocity $\omega_2$ (block 109). Once again, given the oscillatory nature of the quadrature current signal $I_q$ in the considered stage, the acquired value will be the mean value.

It should be observed that in this step the control unit 4 can calculate the torque $T_2$ required from the motor to overcome the frictions of the rotary system at the second angular velocity $\omega_2$ (block 110).

In a final step of the measurement method, the control unit calculates, using the calculations acquired in the aforementioned formula (6), the desired moment of inertia J.

The value of the moment of inertia J can thus be used in various manners to optimize the washing cycle of the washing machine 1.

As mentioned previously, obtaining the electromotive torque starting from the quadrature current $I_q$ requires knowing the magnetic flux $\Phi$ linked by the stator magnetic circuit of the electric motor 3. Such quantity is known from the magnetic circuit, but it can also be subjected to variations in particular due to production variability.

Figure 4:
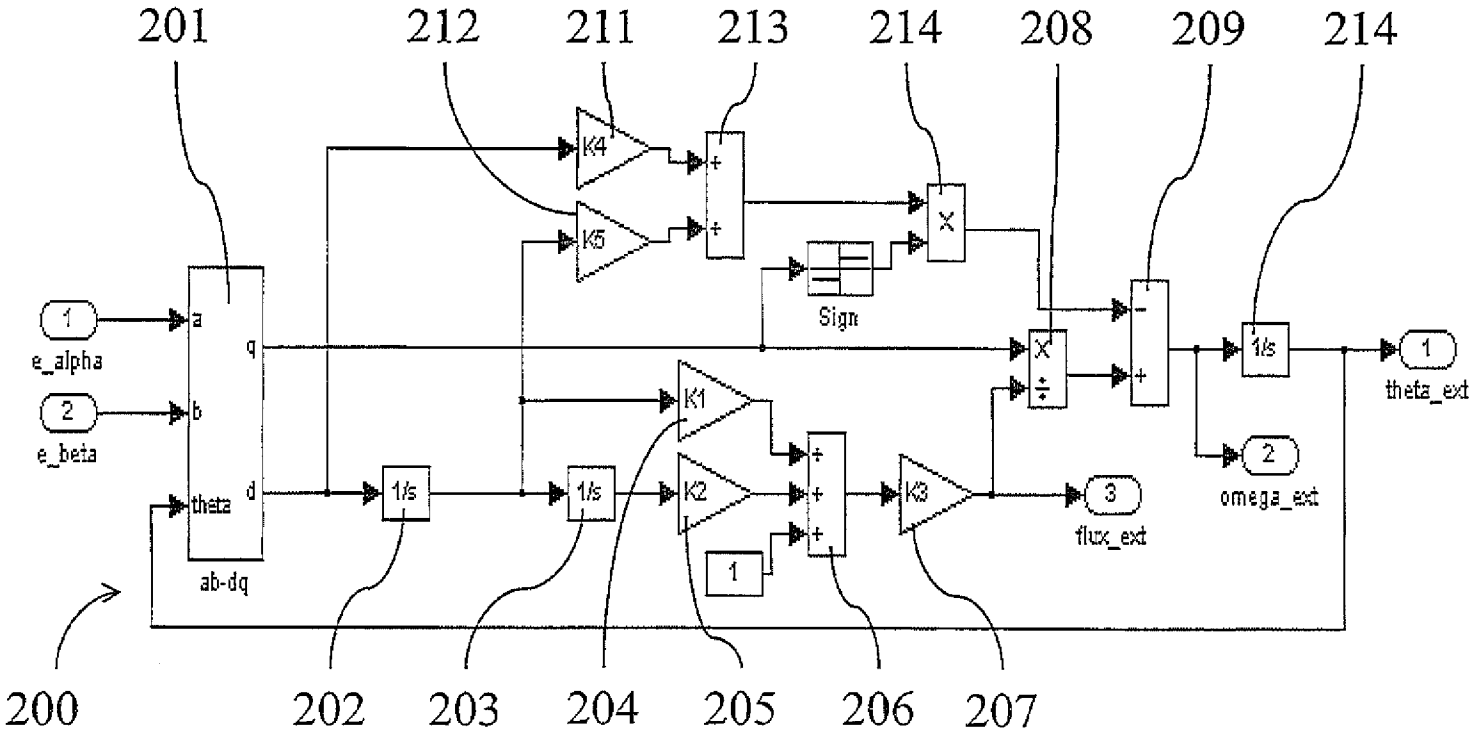
FIG. 4 represents a block diagram of an estimation algorithm of the magnetic flux used by the method according to the present invention.

In the present method, in order to improve the final measurement accuracy of the moment of inertia J, the linked flux $\Phi$ is obtained through an estimation algorithm 200 represented in FIG. 4.

Algorithms of this type are usually used for controlling electrical motors in sensorless mode, given that, besides the value of the linked flux, they also allow obtaining an estimation of the position and angular velocity of the rotor. In the case of the present invention, though the synchronous electric motor 3 is already provided with a Hall effect sensor 5, the use of the estimation algorithm 200 allows obtaining a more accurate value for the linked magnetic flux $\Phi$.

The algorithm comprises a processing block 201 which, starting from the voltage values detected by the control unit 4 and from the angular estimated position $\theta$, identifies the Park transforms of the voltage $V_q$ and $V_d$.

An estimation of the flux $\Phi$ is obtained starting from the value $V_d$, i.e. from the voltage component which influences the linked magnetic flux. In particular, the value $V_d$ traverses a first integrator 202, then it is multiplied by a first coefficient K1 (block 204) and it constitutes the input of a first adder block 205. The signal coming from the first integrator 202 also constitutes the input of a second integrator 203, whose output, multiplied by a second coefficient K2, constitutes the second input of the first adder block 205. A third input of the first adder block is given by a unitary value. The estimate of the flux $\Phi$ (flux_ext variable in FIG. 4) is defined by the output of the adder block 206, multiplied by a third coefficient K3 (block 207).

A divider block 208 receiving—in input—the value $V_d$ exiting from the processing block 201 and the value $\Phi$ obtained from the previously described blocks estimates a value of the angular velocity according to the formula $\omega=V_d/\Phi$. Such value is corrected through a subtractor block 209 which subtracts the correction signal therefrom.

Such correction signal is obtained from the sum, performed by the second adder block 213, of the signal $V_d$ multiplied by a fourth coefficient K4 and by the signal exiting from the first integrator 202 multiplied by a fifth coefficient K5. The sign of the correction signal is inverted, through the multiplier block 214, when the signal $V_q$ acquires negative values.

The output of the subtractor block 209 constitutes the estimation of the angular velocity $\omega$ of the rotor (omega_ext variable in figure); thus, such signal traverses a third integrator block 215 to define the estimation of the angular position $\theta$ (theta_ext variable), then fed-back to the processing block of 201.

Under ideal conditions it would be sufficient to set the third angular coefficient K3 equivalent to a value constant equal to the linked flux measured under nominal conditions and the remaining angular coefficients K1, K2, K3, K4 equivalent to zero to meet the conditions of synchronism of the estimation algorithm.

Due to the uncertainty of the system for measuring and estimating parameters, correction terms are however required to guarantee the correct synchronisation of the estimator: the fourth and fifth coefficient K4, K5 nullify the aligning error on the calculation of the angular position $\theta$; the first and the second coefficient K1, K2 correct the errors of the third coefficient K3 for calculating the flux.

In an alternative embodiment, the flux $\Phi$ can be estimated using computational instruments simplified with respect to the estimation algorithm described previously.

First and foremost, in the presence of a sensor for detecting the temperature at the permanent magnet, there can be obtained an estimation of the flux $\Phi$ considering the thermal derivative, according to the formula:

$$\Phi=\Phi_{Ref}(T-T_{Ref})(1-\delta) \tag{7}$$

where $\Phi_{ref}$ represents a nominal flux value at a reference temperature $T_{ref}$, for example 25° C., while T and $\delta$ respectively identify the measured temperature (which should be greater than the reference temperature) and the thermal coefficient of the permanent magnet.

The performed estimation can be further refined by introducing a correction coefficient k considering the construction variability of the motor, according to the formula:

$$\Phi=k\cdot\Phi_{Ref}(T-T_{Ref})(1-\delta) \tag{8}$$

Such correction coefficient k can be obtained, according to the previously given equation (5), during the test by measuring quadrature current $I_q$ during the operation with known torque and reference temperature. The correction coefficient can thus be stored in the control unit and referred to when estimating the flux.

Obviously the method and washing machine described above can be subjected—by a man skilled in the art with the aim of meeting contingent and specific requirements—to various modifications and variants, all falling within the scope of protection of the invention as defined by the following claims.

The invention claimed is:

1. A method for measuring the moment of inertia (J) of a washing machine drum containing a load, performed by a control unit, comprising the steps of:

setting said drum in rotation by means of a drive system comprising a permanent magnet synchronous electric motor connected to said control unit, taking it to a first angular spin velocity ($\omega_1$) of the load;

identifying a synchronization point in a periodic signal of the quadrature current ($I_q$) absorbed by the synchronous electric motor at said first angular velocity ($\omega_1$), wherein the synchronisation point is a peak point of said periodic signal generated by a known load unbalance condition so as to eliminate measurement error due to the unbalance load;

starting, at said synchronization point, an acceleration transient of said drum with constant electromotive torque ($T_{em_acc}$) delivered by the synchronous electric motor;

interrupting the acceleration transient once a second angular velocity ($\omega_2$) has been reached;

acquiring a time duration ($\Delta t$) of the acceleration transient;

processing an indirect measurement of the moment of inertia (J) of said drum according to the formula:

$$J=T_{acc}\cdot\Delta t/\Delta\omega$$

wherein $\Delta t$ is the time duration value of the acceleration transient, $\Delta\omega$ is the variation in angular velocity of the acceleration transient ($\Delta\omega=\omega_2-\omega_1$), and $T_{acc}$ is the torque yielded to the drum during the acceleration transient, wherein $T_{acc}$ is the electromotive torque ($T_{em_acc}$) excluding the torque required to overcome the friction losses in the drive system at the angular velocities $\omega_1$ and $\omega_2$.

2. The measurement method according to claim 1, also comprising steps of measuring the torque (T1) delivered by the electric motor at the first angular velocity ($\omega$1) and the torque (T2) delivered by the electric motor at the second angular velocity ($\omega$2), said value of torque yielded (Tacc) to the drum being estimated by subtracting an average of said torques from the electromotive torque (Tem_acc) delivered by the synchronous electric motor during the acceleration transient.

3. The measurement method according to claim 1, wherein the step of interrupting the acceleration transient once a second angular velocity ($\omega$2) has been reached comprises periodically acquiring an angular velocity of the drum through a position sensor during the acceleration transient and, once it has been detected that the second angular velocity ($\omega$2) has been reached, controlling the synchronous electric motor in feedback, keeping its angular velocity at the value of the second angular velocity ($\omega$2).

4. The measurement method according to claim 1, wherein the step of setting the drum in rotation taking it to a first angular velocity ($\omega$1) comprises controlling the synchronous electric motor in feedback, comparing its angular velocity acquired by a position sensor with the desired first angular velocity ($\omega$1).

5. The measurement method according to claim 4, wherein said position sensor is a Hall effect sensor.

6. The measurement method according to claim 1, also comprising a step of estimating the linked magnetic flux value ($\Phi$) from state variables of the synchronous electric motor, said magnetic flux value being used to calculate the torques delivered by the synchronous electric motor from the value of absorbed quadrature current (Iq).

7. The measurement method according to claim 6, wherein the magnetic flux value ($\Phi$) is estimated by correcting a nominal magnetic flux value ($\Phi$ref) at a reference temperature (Tref) according to a measured temperature of the motor (T).

8. The measurement method according to claim 7, wherein the magnetic flux value ($\Phi$) is estimated considering a correction coefficient (k), identifying the constructional variability of the motor, measured by way of experiment by operating the motor with known torque in a testing step.

9. The measurement method according to claim 8, wherein the magnetic flux value (t) is estimated according to the formula:

$$\Phi=k\cdot\Phi_{Ref}(T-T_{Ref})(1-\delta);$$

wherein k is a correction coefficient, identifying the construction variability of the motor, measured by way of experiment by operating the motor with known torque in a testing step; and wherein $\delta$ is a thermal coefficient of a permanent magnet of the permanent magnet synchronous electric motor.

10. The measurement method according to claim 6, wherein said step of estimating the magnetic flux value ($\Phi$) uses an estimation algorithm that uses correction coefficients (K1-K5) to compensate for the errors made in measuring the state variables of the motor and in estimating its operating parameters.

* * * * *